US005765399A

United States Patent [19]

Huss et al.

[11] Patent Number: 5,765,399

[45] Date of Patent: Jun. 16, 1998

[54] METHOD AND APPARATUS FOR DETECTING A THREAD SUPPLY BOUNDARY ON A YARN STORAGE DRUM

[75] Inventors: Rolf Huss, Lossburg, Germany; Kurt Arne Gunnar Jacobsson; Lars Helge Gottfrid Tholander, both of Ulricehamn, Sweden; Friedrich Weber, Herzogsweiler, Germany

[73] Assignees: Iro AB, Ulricehamn, Sweden; Memminger-Iro GmbH, Dornstetten, Germany

[21] Appl. No.: 656,284

[22] PCT Filed: Nov. 3, 1994

[86] PCT No.: PCT/EP94/03616

§ 371 Date: Aug. 16, 1996

§ 102(e) Date: Aug. 16, 1996

[87] PCT Pub. No.: WO95/16628

PCT Pub. Date: Jun. 22, 1995

[30] Foreign Application Priority Data

Dec. 17, 1993 [SE] Sweden ..... 9304257

[51] Int. Cl.[6] ..... B65H 51/22; D03D 47/36; D04B 15/48

[52] U.S. Cl. ..... 66/132 R; 139/452

[58] Field of Search ..... 139/452; 66/132 T, 66/132 R; 242/47.01

[56] References Cited

U.S. PATENT DOCUMENTS

| | | | |
|---|---|---|---|
| 4,180,215 | 12/1979 | Nurk . | |
| 4,325,520 | 4/1982 | Hintsch . | |
| 4,687,149 | 8/1987 | Riva | 242/47.01 |
| 4,715,411 | 12/1987 | Van Bogaert et al. | 139/452 |
| 4,850,400 | 7/1989 | Gorris | 242/47.01 |
| 5,211,347 | 5/1993 | Riva | 242/47.01 |
| 5,377,922 | 1/1995 | Fredriksson et al. | 242/47.01 |
| 5,590,547 | 1/1997 | Conzelmann | 139/452 X |

FOREIGN PATENT DOCUMENTS

| | | | |
|---|---|---|---|
| 0 174 039 A2 | 3/1986 | European Pat. Off. . | |
| 0 192 851 A2 | 9/1986 | European Pat. Off. . | |
| 1 937 058 | 3/1971 | Germany . | |
| 22 21 655 | 8/1977 | Germany . | |
| 393 218 | 10/1965 | Switzerland . | |
| 1 168 905 | 10/1969 | United Kingdom . | |
| 2 277 533 | 11/1994 | United Kingdom | 242/47.01 |

*Primary Examiner*—Andy Falik

*Attorney, Agent, or Firm*—Flynn, Thiel, Boutell & Tanis, P.C.

[57] ABSTRACT

For determining the movement of a thread supply boundary on the storage surface of a thread storage and feed device, different scanning properties of at least two circumferentially offset circumferential sections of the storage surface are scanned simultaneously and converted into storage surface signals which are nonidentical among themselves and which are discriminated from thread signals which are identical among themselves. The thread signals are generated by sensors which scan a scanning zone on the storage surface and formed on the basis of a scanning property of the thread windings when the thread supply is present in the scanning zone. The thread storage and feed device is provided with first and second circumferential sections on the storage surface differing from one another with respect to their scanning properties, and a plurality of sensors. The sensors are spaced approximately in the circumferential direction of the storage body in such a way that at least a first circumferential section of the storage surface can be scanned by one sensor and, simultaneously, a second circumferential section of the storage surface can be scanned by at least one additional sensor.

29 Claims, 7 Drawing Sheets

FIG.1A
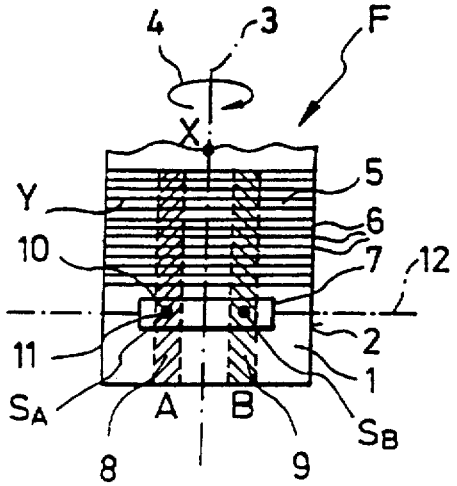
FIG.1B
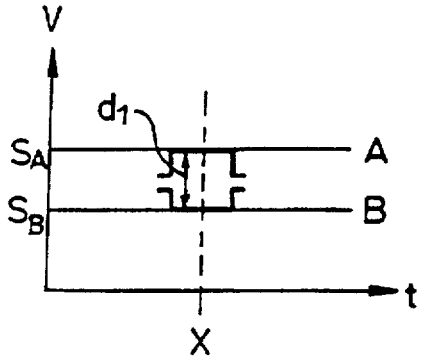
FIG.2A
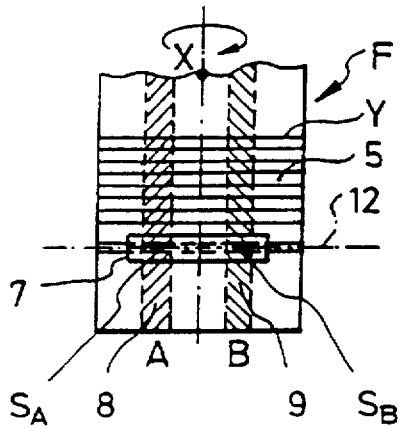
FIG.2B
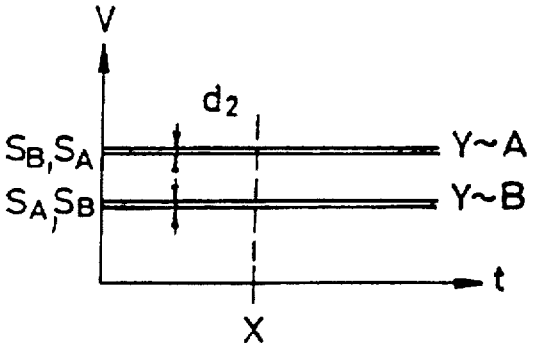
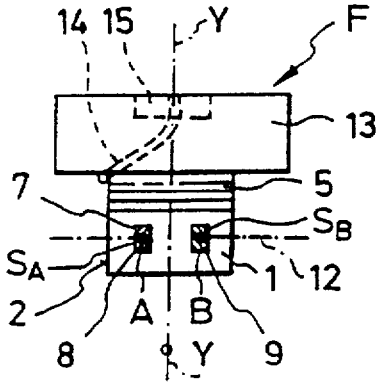
FIG.3A
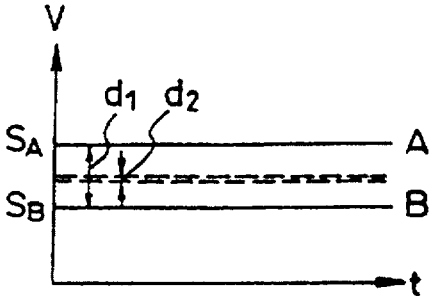
FIG.3B

METHOD AND APPARATUS FOR DETECTING A THREAD SUPPLY BOUNDARY ON A YARN STORAGE DRUM

FIELD OF THE INVENTION

The present invention refers to a thread storage and feed device and a method for detecting a yarn storage in the yarn storage and feed device.

BACKGROUND OF THE RELATED ART

A thread storage and feed device for knitting machines known from U.S. Pat. No. 4,180,215 is provided with a storage body which is rotatably driven and which has a concave contour line. The storage body has a light-transmitting wall and different circumferential sections, e.g. longitudinal grooves or longitudinal slots so as to define small contact surfaces for the thread windings. Inside the storage body, a light-generating transmitter and a reflected-light receiver are arranged. Outside of the storage surface, a mirror is provided which reflects the light of the transmitter in the scanning zone to the receiver as long as no thread windings are located in said scanning zone. The axial transition between reflection and shading, which takes place in the axial direction, is detected so as to control the rotary drive means of the storage body. The reflection or absorption behavior of the thread windings influences the discrimination of the sensor signals. White, shiny thread windings of one thread quality will reflect the light like the mirror; whereas extremely thin thread windings of another thread quality will not sufficiently shade off reflected light. In these cases, the signal difference between the sensor signals will decrease, and this will have the effect that the sensitivity with which the sensor responds will have to be raised, whereupon the interfering influence of extraneous light, contaminations or of a decreasing optical transparency of the wall of the storage body will become stronger.

Similar problems arise with other optoelectronic sensors used for scanning thread supply boundaries by comparing the reflection behaviour of the thread windings with the reflection behaviour of the storage surface.

In thread storage and feed devices for knitting machines known from DE-C2 22 16 55 and GB-C-1 168 905, movements of the boundary of the thread supply are determined by a sensing element defining an inclined advance element and a sensor for actuating a switch in response to the degree of inclination. These functions mutually influence one another. In operation, these devices show a hysteresis resulting in an inaccurate operating behaviour. Furthermore, these devices react sensitively when the tension of the thread supplied changes.

It is the object of the present invention to provide a simple method to be used universally on various types of thread storage and feed devices. A further object is to provide a structurally simple thread storage and feed device by means of which it is possible to scan the movements of the boundary of the thread supply free from any susceptibility to trouble and, to a large extent, independently of the thread quality and the properties of the thread material.

SUMMARY OF THE INVENTION

According to the method of the invention, the respective control signal is either derived from the appearance or disappearance of the simultaneous nonidentical storage surface signals, or the control signals are derived from the discrimination between the simultaneous nonidentical storage surface signals and the thread signals which are identical among themselves, the very clear difference between the identicalness and the nonidenticalness being evaluated in any case. Even if the thread signals are similar to one of the nonidentical simultaneous storage surface signals, a control signal can be derived in a reliable manner. The quality of the scanning result is high because the scanning is carried out not only "axially" but simultaneously also in the circumferential direction. Any interfering influence of the thread quality is eliminated. The method is adapted to be used for rotatable storage bodies as well as for stationary storage bodies, and it is equally advantageous for thread storage and feed devices for weaving machines as well as for knitting machines.

In the thread storage and feed device also according to the invention, the sensors detect precisely whether or not the boundary of the thread supply has reached the scanning zone. This information is very reliable, not susceptible to trouble and is independent of the respective thread quality processed, since thread windings in the scanning zone cannot simultaneously cause nonidentical signals at any time. Scanning properties of the two circumferential sections of the storage surface which are clearly different from the scanning properties of the thread windings can structurally be predetermined without any difficulties, e.g. by structural measures on the storage surface, by different materials, by different distances from the sensors, by auxiliary elements which are structurally integrated in the storage surface, by coloring, coatings, finishings and the like. In this connection, it is important that the sensors scan an area and not only individual points.

BRIEF DESCRIPTION OF THE DRAWINGS

Embodiments of the subject matter of the invention are now explained on the basis of the drawings, in which:

FIG. 1A shows schematically part of a thread storage and feed device including a rotatable storage body in one operating position, FIG. 1B shows a signal diagram associated with the operating position of FIG. 1A, FIG. 2A shows the device according to FIG. 1A in another operating position, FIG. 2B shows a signal diagram associated with the operating position of FIG. 2A, FIG. 3A shows a thread storage and feed device including a stationary storage body of another embodiment, FIG. 3B shows a signal diagram associated with the storage body of FIG. 3A.

DETAILED DESCRIPTION

Figure 4:
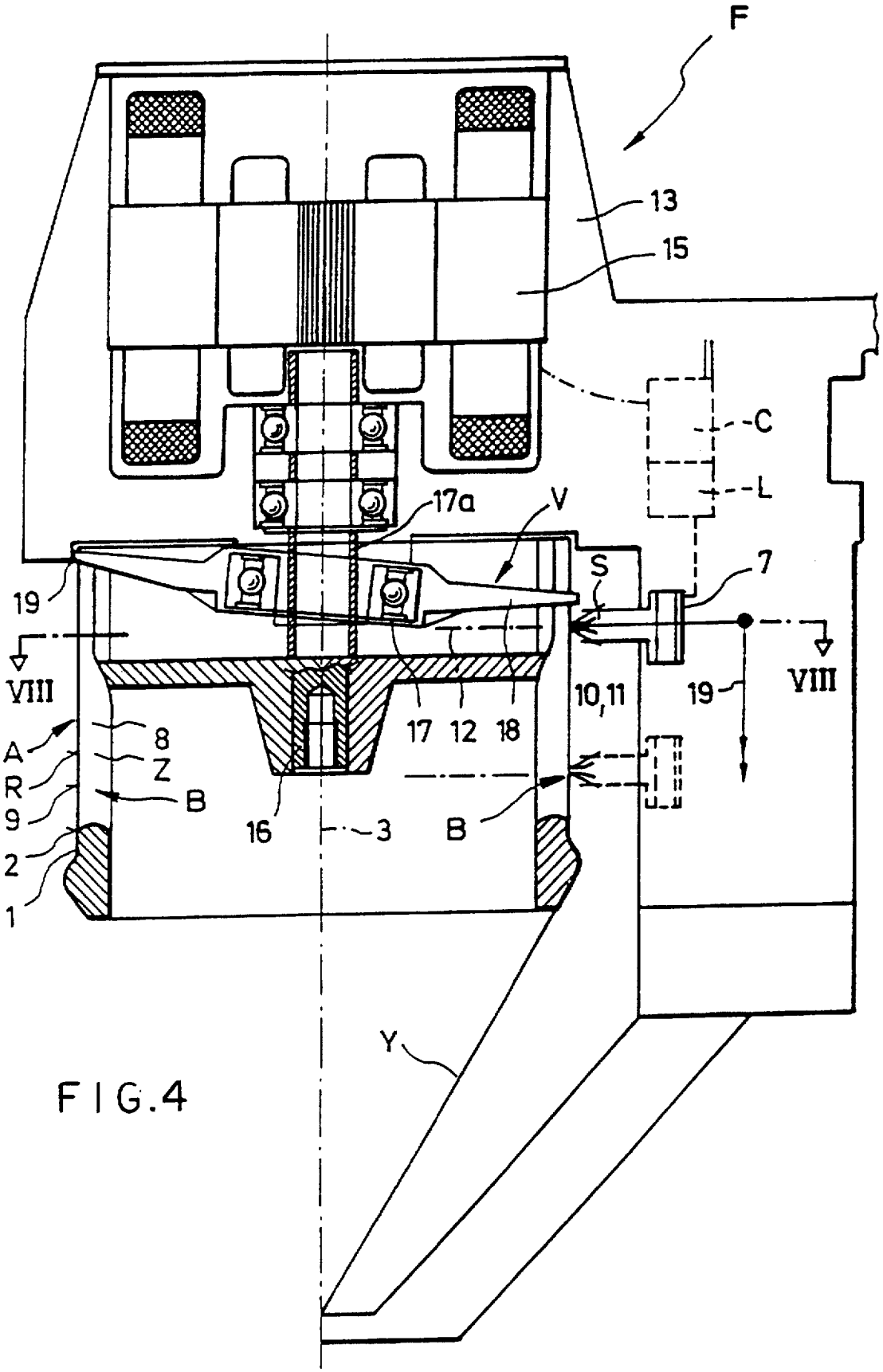
FIG. 4 shows a longitudinal section of a detailed embodiment of a thread storage and feed device in partial cross section.

A thread storage and feed device F according to FIG. 1 is provided with a drumshaped storage body 1 having a storage surface 2 for a thread supply 5 consisting of windings 6 of a thread Y. The storage body 1 is adapted to be driven such that it rotates about an axis 3 (arrow 4) and it is adapted to be stopped. The thread Y is tangentially supplied to the storage body 1 and axially drawn off therefrom (varying thread length feed to a knitting machine). The movement of the lower boundary of the thread supply 5 is scanned by means of a scanning device 7 with respect to its presence or absence in a circumferentially extending scanning zone 12 (shown as a dot-and-dash line for the sake of simplicity), e.g. for the purpose of generating drive control signals for a rotary drive means of the storage body 1, which is not shown in FIG. 1 and which drives the storage body approximately in accordance with the amount of thread consumed in order to replenish the thread.

The storage surface 2 is provided with at least two circumferential sections 8, 9 with different scanning properties A, B for scanning by two sensors SA, SB which are arranged approximately in the circumferential direction and which are spaced apart in such a way that they simultaneously directed towards both circumferential sections 8, 9 respectively. These sensors are, for example, optoelectronic sensors SA, SB consisting each of a light source 10 (infrared light) and of a receiver 11 (photodiode) responding to reflected light. The different scanning properties A, B of the circumferential sections 8, 9 can be predetermined by: high-contrast different colors, different light reflections and absorptions, different distances from the sensors and the like. When optoelectronic sensors with sharp imaging of the scanning zone 12 are used, the respective scanning properties A, B can originate from different patterns on the circumferential sections 8, 9.

In FIG. 1, only one first and one second circumferential section 8, 9 are provided. Hence, the rotary drive means will stop the storage body 1, if necessary, exclusively at a predetermined rotary position X in which the sensors SA, SB are simultaneously directed at the circumferential sections 8, 9 respectively.

In the embodiment according to FIG. 4 to 9, an arbitrary number of first and second circumferential sections 8, 9 of approximately the same circumferential width are alternately distributed over the circumference of the storage surface in a regular arrangement. At least three sensors S are aligned with one another approximately in the circumferential direction and spaced in such a way that that, independently of the rotary position of the storage body 1, one of said sensors is always directed at a first and another one of said sensors is always directed at a second circumferential section 8, 9 at the same time. The storage body 1 thus can be stopped at any rotary position. The sensors S generate sensor signals which may have different signal levels that are determined by the respective scanning properties A, B. For example, the sensors S may be optical sensors which detect differences in light reflectivity of the properties A, B.

In the diagram of FIG. 1, the sensor signals produced are shown for an operating position at which the thread supply 5 is located at a distance from the scanning zone 12. During the rotary movement of the storage body 1 in FIG. 1, the sensors SA, SB will produce signals when A and B pass through X, one of said signals having a high signal level and the other one having a low signal level, the signal difference being dl. When the storage body 1 stops at the rotary position X, the scanning will provide continuous storage surface signals A, B with the signal difference d1 (differential voltage). As long as the two discontinuous storage surface signals occur during scanning (when the storage body 1 is rotating) or the two continuous storage surface signals A, B occur (when the storage body 1 is standing still), the thread supply 5 has not reached the scanning zone 12. The rotary drive means is to be switched on, or it is to be maintained in the switched-on condition, or it is to be accelerated in order to wind weft thread onto the storage body 1.

When the storage body 1 continues to rotate and assuming that the amount of drawn-off thread Y consumed is smaller than the amount of thread supplied, the thread supply 5, which is moved towards the scanning zone 12 by an advance element which is not shown (active, driven advance element or advance caused by conicity), will reach the scanning zone 12.

Thus, at the rotary position X or the storage body 1, all sensors SA, SB produce continuous thread signals Y which are identical among themselves (respective double lines in the diagram of FIG. 2 with a possibly measurable difference d2). The double line shown on a higher level in the diagram represents thread signals resulting from a thread having a similar scanning property as the circumferential section 8, whereas the lower double line shows thread signals resulting from a thread Y having the scanning property B of the circumferential section 9. Due to a signal change, i.e. the disappearance of nonidentical signals, which is due to the detected difference between the nonidentical and the identical signals, or due to the identical signals, the rotary drive means is decelerated or brought to a standstill. In this case it will stop at the rotary position X. The scanning then is continued while the storage body is standing still, the thread signals which are identical among themselves being still applied. If the thread is consumed, the circumferential sections 8, 9 will be exposed in the scanning zone 12. Sensors SA, SB then will simultaneously produce nonidentical, continuous storage surface signals (diagram of FIG. 1). The rotary drive means will be switched on.

In the thread storage and feed device F according to FIG. 3, the storage body 1 is arranged in a stationary manner on a housing 13. Said housing 13 contains the rotary drive means 15 which drives a winding member 14 for the purpose of forming a thread supply 5. An advance means, which is not shown, transports the thread supply 5 or the thread windings 6 in the axial direction. The consumed thread Y is unwound overhead from the thread supply 5. The scanning device 7 is provided with two sensors SA, SB which are directed at the scanning zone 12. The storage surface 2 has circumferential sections 8, 9 which are offset in the circumferential direction and which differ from one another with regard to their scanning properties A, B. In the scanning device 7, which may be secured to the housing 13, the sensors SA, SB are spaced apart in the circumferential direction in such a way that each sensor SA, SB is directed at one circumferential section 8, 9.

In FIG. 3, the boundary of the thread supply 5 has not yet reached the scanning zone 12. In the diagram of FIG. 3, the storage surface signals produced by the sensors SA, SB are shown as horizontal lines with different signal levels (difference dl). The rotary drive means 15 is switched on or remains switched on for supplying thread Y until said thread covers the circumferential sections 8, 9 in the scanning zone 12. On the basis of the assumption that the scanning properties of the thread supply 5 lie approximately in the middle between the scanning properties A and B, the sensors SA, SB will then produce identical thread signals (broken double line). From these identical thread signals the conclusion is drawn that the rotary drive means 15 has to be brought to a standstill. The scanning, which is still carried out, confirms the standstill as long as no change (no consumption) takes place. If thread Y is again consumed, the circumferential sections 8, 9 will be exposed again. Nonidentical storage surface signals then will be applied. The rotary drive means 15 is switched on again, if necessary with a certain delay.

In the thread storage and feed device F according to FIGS. 4, 5, 8 and 9, the housing 13, which, with the aid of one housing component, positions the scanning device 7 such that it is directed at the storage surface 2, has supported therein the rotary drive means 15 (electromotor) with the aid of a shaft 16 having secured thereto the storage body 1 constructed as a rod cage. This rod cage consists of longitudinally extending rods R separated by interspaces Z (cf. FIG. 5), said rods R and said interspaces Z having the same width and being arranged in an alternating mode. Instead of continuous interspaces Z, it is also possible to form the cage with externally open longitudinal grooves. The rods R and the interspaces Z or the longitudinal grooves define continguous first and second circumferential sections 8 and 9 with clearly different scanning properties for the sensors S of the scanning device 7. Three sensors S are spaced in the circumferential direction in such a way that at least one first circumferential section 8 and at least one second circumferential section 9 are simultaneously scanned by at least one sensor S.

The storage body 1 has provided therein a star of spokes or a spoked ring 19 as an advance element V whose spokes 18 extend through the interspaces Z and up to a rotary bearing 17 on the shaft 16. The rotary bearing 17 and the star of spokes 19 extend at an oblique angle relative to the axis 3 of the storage body 1. Due to the fact that the rotary bearing 17 is arranged on a sleeve 17*a* which is held such that it is secured against rotation relative to the shaft 16, the star of spokes 19 will displace the thread supply 5 towards the scanning zone 12 during the rotary movement of the storage body 1.

The thread storage and feed device F according to FIG. 4 serves e.g. to supply thread to a knitting machine. The consumed thread is unwound overhead and in the axial direction. The scanning device 7 can be displaced in the direction of an arrow 19' so as to vary the thread supply size. The scanning device 7 is connected to a control means C for the rotary drive means 15 via a circuit L. As has already been explained, said rotary drive means 15 feeds, by rotating the storage body 1, to the thread supply 5 the amount of thread Y which is necessary for maintaining the determined thread supply size when thread is being consumed.

Figure 8:
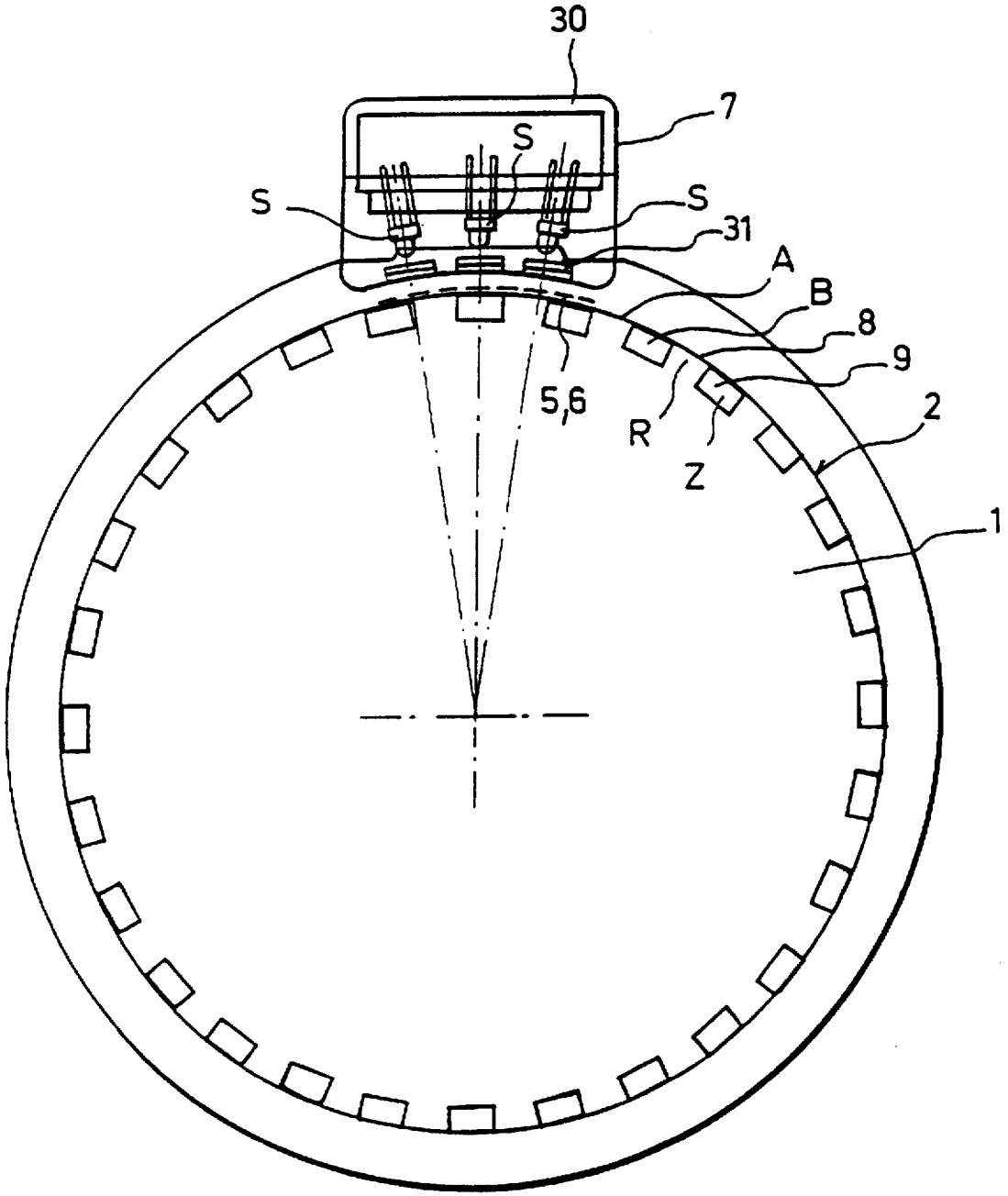
FIG. 8 shows an axial section in the plane VIII—VIII in FIG. 4.

According to FIG. 8, the three sensors S are jointly accommodated in a housing 30 which is anchored on the housing 13. Cover disks 31 protect the sensors S against contamination.

Figure 5:
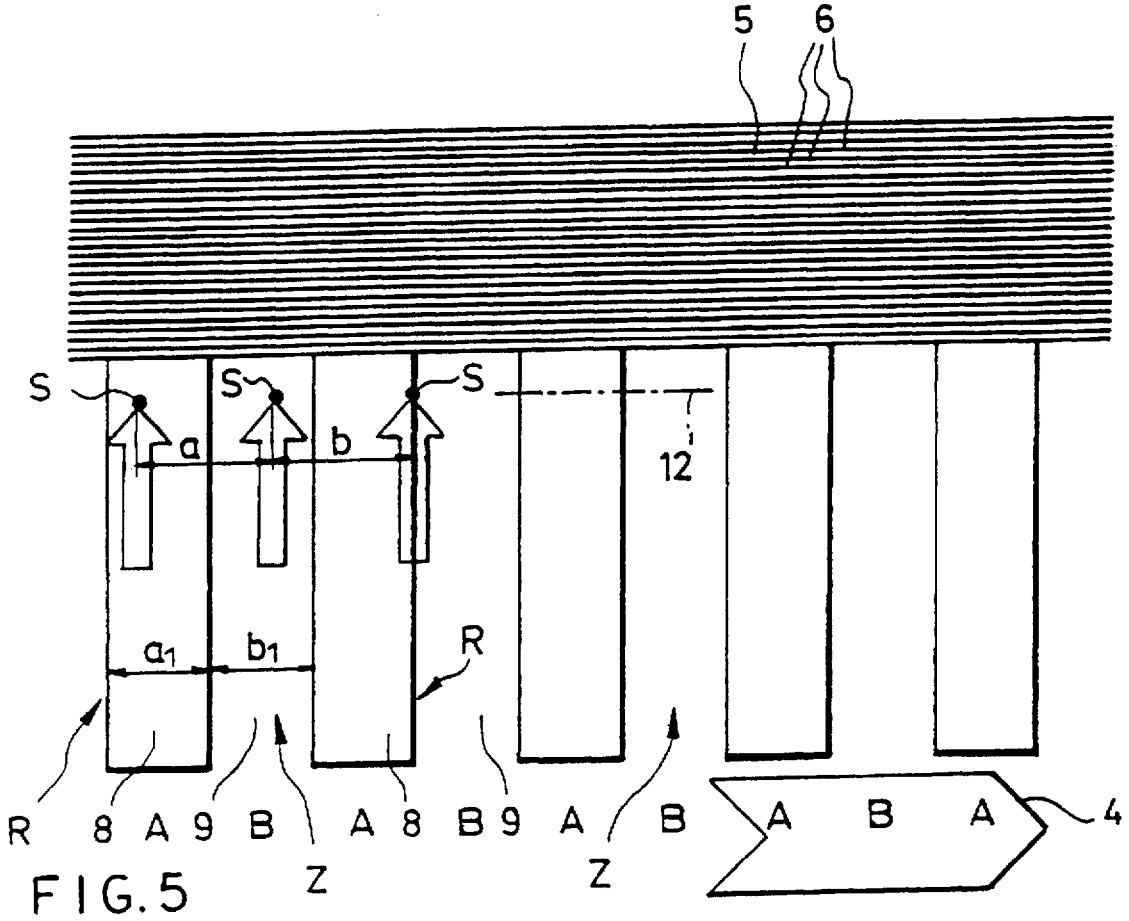
FIG. 5 shows a flat top view of part of the storage surface of FIG. 4 in the plane of the drawing.
Figure 6:
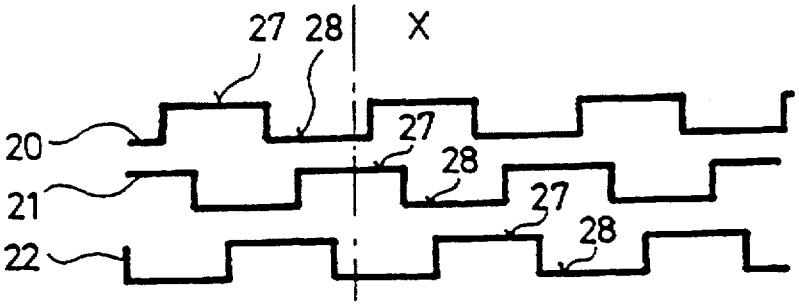
FIG. 6 shows a signal waveform concerning FIG. 4 in one operating position.

FIG. 5 shows a flat top view of five rods R or first circumferential sections 8 with the intermediate second circumferential sections 9 (interspaces Z or longitudinal grooves). The scanning zone 12 with the three sensors S is located just out side of the thread supply 5. The circumferential distances a and b between respective neighboring sensors are adapted to the circumferential widths a1 and b1 of the circumferential sections 8 and 9 in such a way that, in any rotary position of the storage body 1, at least one sensor S will scan a first circumferential section 8 and at least one additional sensor S will simultaneously scan a second circumferential section 9. In the embodiment shown, distances a and b are slightly larger than distances a1 and b1. However, a and b may just as well be smaller than a1 and b1. If the circumferential sections 8 and 9 have different widths, it may be necessary to arrange the sensors at specific distances from one another for fulfilling the above-mentioned requirement. When three sensors as well as longitudinal rods R and interspaces Z having the same width are provided, it will be expedient when the distance between two sensors is ⅔ of the width of a longitudinal rod R or an integral multiple thereof.

The circumferential sections 8, 9 in FIG. 5 have different scanning properties A, B. When the storage body rotates in the direction of arrow 4, the sensors S produce the storage surface signal chains 20, 21 and 22 shown in FIG. 6. Each signal chain 20, 21, 22 consists of successive high and low signal levels 27, 28. Two nonidentical storage surface signals are simultaneously present at each rotary position of the storage body. At the rotary position X in FIG. 6, a low signal level 28 is present in signal chain 20, a high signal level 27 in signal chain 21, and a low signal level 28 in signal chain 22. The information that the thread supply 5 is absent from the scanning zone 12 can be inferred from the simultaneous occurrence of at least two nonidentical storage surface signal levels 27, 28.

Figure 7:
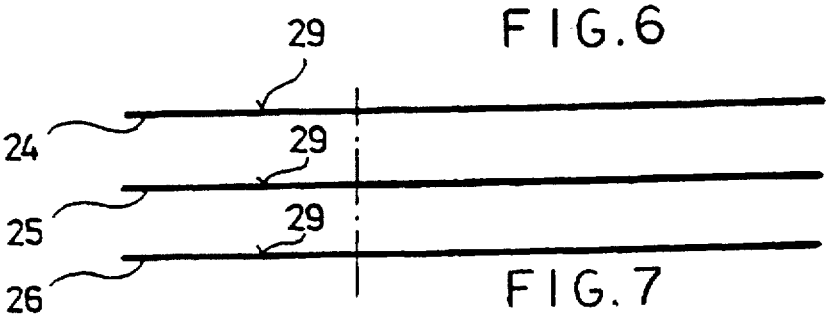
FIG. 7 shows a signal waveform concerning FIG. 5 in another operating position.

As soon as thread Y is fed and the thread supply reaches the scanning zone 12 during the advance movement, the circumferential sections 8, 9 will be covered. The sensors S will then produce the continuous thread signal chains 24, 25 and 26 which are shown in FIG. 7 and which have the signal level 29. The rotary drive means will be brought to a standstill or decelerated. The scanning will be continued. When, as a result of thread consumption, the circumferential sections 8, 9 in the scanning zone 12 are exposed again, the nonidentical storage surface signal levels, from which a control signal for switching on or accelerating the rotary drive means is derived, will be reapplied immediately.

Figure 9:
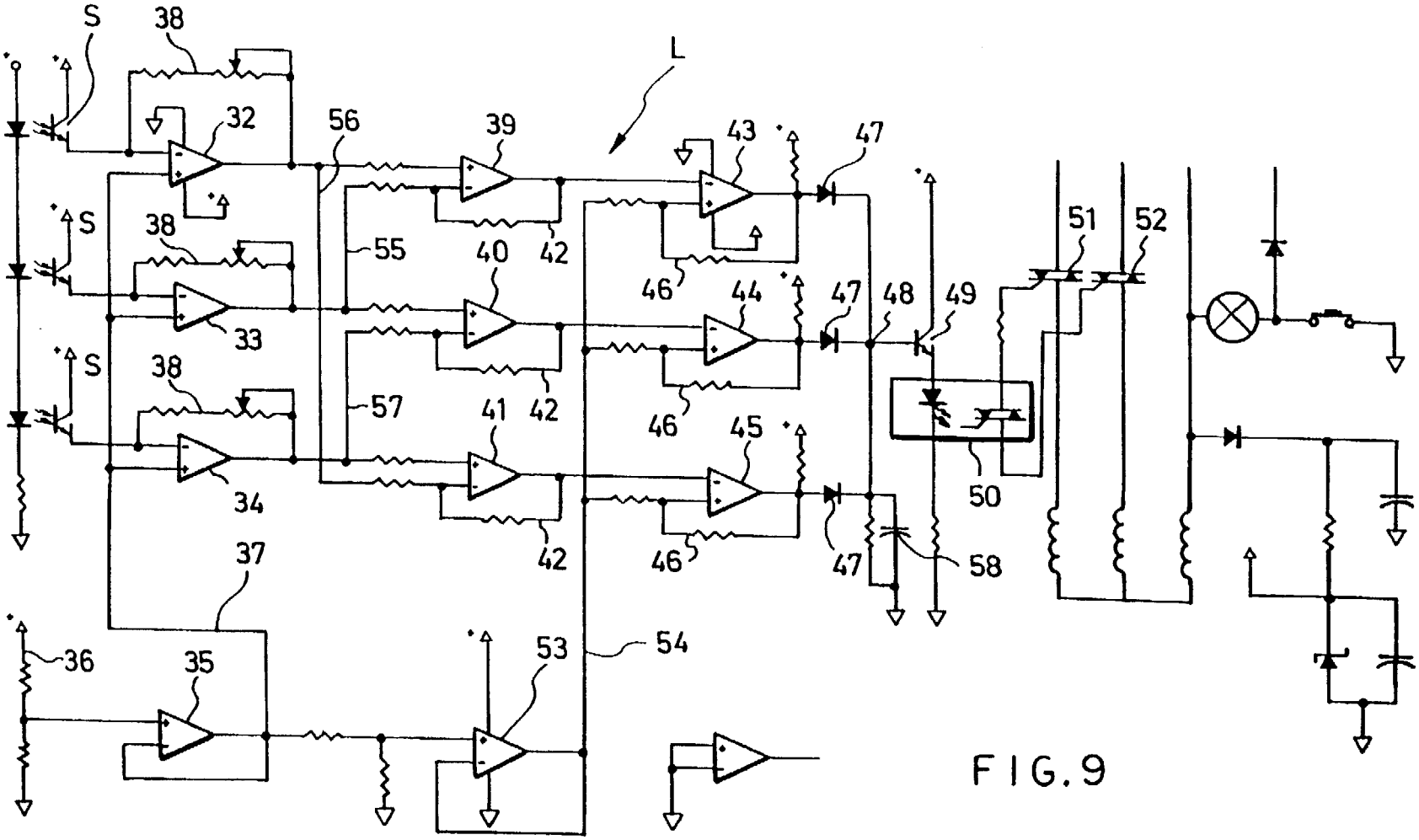
FIG. 9 shows a block diagram of a circuit of a control system of the device of FIGS. 1 and 2.

FIG. 9 shows a block diagram of a circuit L (FIG. 4). The sensors S are connected in parallel to inverting gates 32, 33, 34. The second input of each gate 32, 33, 34 has applied (line 37) thereto a reference voltage which is provided by a voltage source 36 via a gate 35. The signal of each sensor S is guided via a loop 38 to the output of gate 32, 33, 34 and is applied to the input of a downstream gate 39, 40 and 41, respectively. The outputs of gates 32, 33, 34 are connected to second inputs of gates 39, 40, 41 via lines 56, 55, 57. Bypass loops 42 lead from the lines 55, 56, 57 to the respective outputs of said gates 39, 40, 41, said loops 42 including identical resistors. The outputs of said gates 39, 40, 41 are connected to first inputs of additional gates 43, 44, 45. The second inputs of said gates 43, 44, 45 have applied thereto via a line 54 a reference voltage which is derived from the voltage source 36 via a gate 53 and which is also applied to the outputs of said gates 43, 44, 45 via loops 46. The outputs of said gates 43, 44, 45 are joined via parallel diodes 47 at a junction point 48 which is connected to the control side of a transistor 49. Parallel to the junction point 48, a capacitor 58 is provided for smoothing the signals. The transistor 49 controls an optocoupler 50 with the aid of which current control elements 51, 52 in supply lines of the rotary drive means (not shown) are controlled.

If simultaneous storage surface signals which are nonidentical among themselves are applied, a specific control signal will be generated at the junction point 48 in the circuit L due to the cross connection by means of lines 55, 56, 57, among other reasons, whereas no control signal or a different control signal will be generated at the junction point 48 if identical thread signals are applied. The level changes occurring in the signal chains 21, 22, 23 during the rotary movement of the storage body 1 are compensated for in the logic circuit. If nonidentical simultaneous storage surface signals are applied, the transistor 49 will switch to the conductive state so that the rotary drive means will have voltage supplied thereto via the optocoupler 50 and the control elements 51, 52. If identical thread signals are applied, the transistor 49 will interrupt the voltage supply of the optocoupler 50 so that the control elements 51, 52 will interrupt or modulate the power supply.

In the case of this processing of the signals of the three sensors, each signal level is compared with every other signal level and the respective difference with its sign is ascertained. If all differences or if at least one of the evaluable differences exceed(s) a predetermined threshold value, the rotary drive means will have power supplied thereto.

Example: thread supply 5 absent from the scanning zone 12, one sensor directed at an interspace Z, one sensor directed at a rod R, one sensor directed at an edge of a rod R; signals of the three sensors 4V, 10V, 7V; first difference −6V; second difference +3V, third difference +3V, evaluable difference 3V or also 9V.

Figure 12:
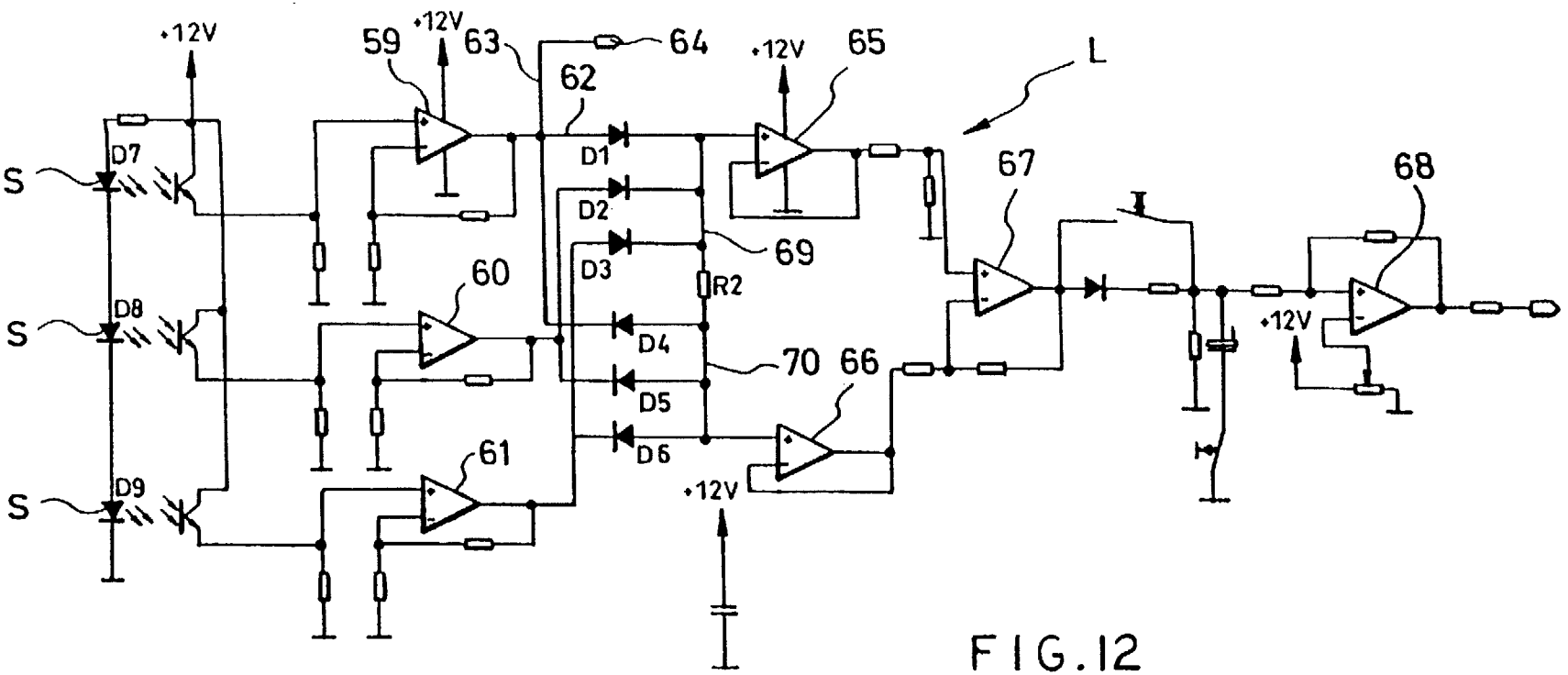
FIG. 12 shows a block diagram of a different embodiment of a circuit of a control system of the device according to FIGS. 1 and 2.

In circuit L according to FIG. 12, the signals of the three sensors S are processed in a different manner by comparing the highest signal level with the lowest signal level and by finding out this difference. If the difference exceeds a threshold value, the rotary drive means will have power supplied thereto. Example as above: 4V, 10V, 7V; largest difference 6V.

The necessary different scanning properties A, B result, for example, from the different light reflections of the longitudinal rods R, 8 and the interspaces Z or longitudinal grooves 9. It will be expedient when the outer surfaces of the longitudinal rods R are mirrored or chromium plated and polished so as to guarantee easy sliding of the thread windings 6 and a strong reflection. A light-absorbing background may be provided in the interspaces Z or longitudinal grooves 9 or behind said interspaces or longitudinal grooves. The sensors used may be any type of sensor which is capable of producing two different signal levels upon scanning the first and second circumferential sections 8, 9.

In circuit L according to FIG. 12, the sensors S consist of infrared sensors D7, D8, D9, which have constantly power supplied thereto, and receivers T1, T2, T3, said infrared sensors and receivers being connected via resistors to downstream operational amplifiers 59, 60, 61 whose amplification effect is determined by the coupling of additional resistors. The outputs of the operational amplifiers 59, 60, 61 are connected, e.g. via lines 62, 69, 70, to a diode network D1, D2, D3 and D4, D5, D6 and a central resistor R2. The useful signal at resistor R2 is tapped by operational amplifiers 65, 66 for producing subsequently a useful signal amplitude by an amplifier 67 in differential connection. The amplifiers 65, 66, 67 form an electrometer subtractor. A subsequent low-pass is provided ahead of an amplifier 68 constituting an adjustable comparator which controls, on its output side, the rotary drive means or which feeds a closed-loop control unit for the rotary drive means, which is not shown.

In addition, a speed detector 64 is connected to line 62 via line 63, said speed detector 64 deriving from the frequency of the output signal changes of the amplifier 59 information on the speed or on the condition "rotation or standstill" or also on the rotary position of the storage body. This information can be used for additional control or supervising functions, e.g. for the rotary drive means, or for error detection. The circuits L in FIG. 12 and 9 only represent possible embodiments. Similar or identical functions can be obtained in an identical or similar manner by means of electronic components which are grouped or interconnected in a different way or by means of a microprocessor control unit.

Figure 10:
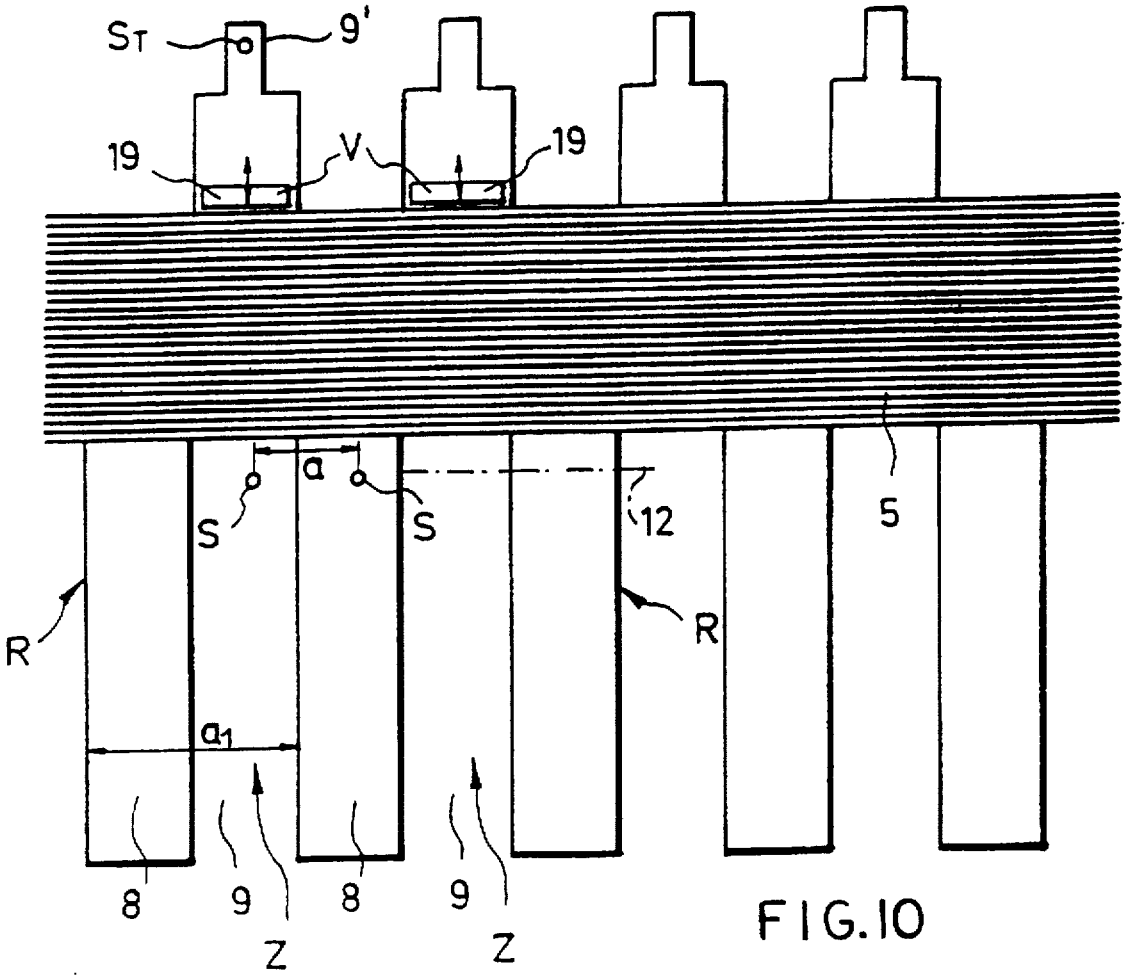
FIG. 10 shows a flat top view of another embodiment similar to that of FIG. 5.
Figure 11:
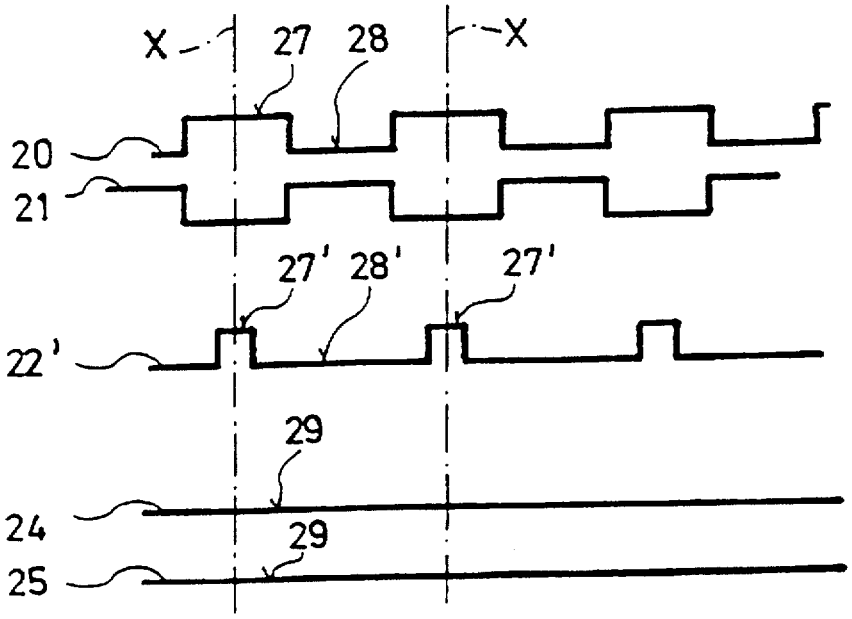
FIG. 11 shows signal waveforms representing two operating conditions for the embodiment of FIG. 10.

In a thread storage and feed device comprising a rotatable storage body 1, longitudinal rods R, 8 and interspaces Z, 9, which are arranged in regular succession and which define the storage surface, are provided according to FIG. 10 and 11. In the scanning zone 12, two sensors S are provided, which, when seen in the circumferential direction, are arranged at a distance "a" from each other. "a" corresponds to half the distance a1 between two longitudinal rods R, 8. The thread supply is transported downwards by means of the advance element V (spokes 19). Above the advance element V, a rotary position sensor $S_T$ is additionally provided, said rotary position sensor $S_T$ being in axial alignment with one of the sensors S. However, the rotary position sensor $S_T$ may just as well be arranged at a different position, or it may scan the shaft of the storage body. In the scanning region of the rotary position sensor $S_T$, the interspaces Z form symmetrically narrowed extensions 9' so that circumferentially spaced storage body sections are formed, which are adapted to be scanned and the circumferential dimensions of which are smaller than the circumferential dimensions of the interspaces Z. The high signal levels 27' in the signal chain 22' of the rotary position sensor $S_T$ are used for scanning, like in the case of a stroboscope, the signal chains 20, 21 and 24, 25 of the sensors S simultaneously and only if a high signal level 27' of the rotary position sensor $S_T$ is applied. In this case, the signal or level transitions at the transitions from the interspaces Z to the rods R are no longer scanned. Also in cases in which three sensors are used (cf. FIGS. 4 and 5), this principle will be expedient for leaving out of account the transition regions upon carrying out the scanning (level change). In order to achieve unequivocal scanning results even if the storage body 1 is standing still, it should be guaranteed that the storage body will exclusively stop at positions at which the extension 9' is directed at the rotary position sensor $S_T$. This can be achieved by using e.g. a stepping motor in the rotary drive means.

Just as the signal chains 20, 21, 22, signal chain 22' is adapted to be evaluated as a current information on the rotational speed, deceleration and acceleration as well as on the standstill or running condition, and it can also be evaluated for additional control or supervising tasks or for controlling the speed of the rotary drive means.

The window or rotary position signals (signal level 27' in FIG. 11) should be temporally shorter than the storage surface signal levels 27, 28 and they should lie within said storage surface signal levels 27, 28.

Safety functions making use of the above-mentioned signal chains will be explained hereinbelow by way of example:

In a thread storage and feed device according to FIGS. 4 to 11, which is provided on a knitting machine, a working signal (device ON) is produced, as usual, for a working thread storage and feed device F. Due to thread consumption, the rotary drive means should run or increase its rotational speed because the thread supply on the storage surface diminishes. If the tension of the thread on the feed side of the storage body increases such that it exceeds the torque of the rotary drive means, said rotary drive means will be blocked. This would cause a malfunction in the operation of the device and of the knitting machine. In view of the fact that each signal chain 20, 21, 22, 22' represents the rotational speed of the storage body and occurs only if said storage body rotates, this precondition is taken into account as a reason for switching off. The control means C of FIG. 4, for example, has associated therewith a machine stopping switch with a time holding function, which responds to the working signal of the thread storage and feed device F and which, when the working signal is applied, waits for a predetermined period of time so as to find out whether a signal chain occurs and whether information on the rotary movement can be tapped. If this information fails to appear for a period of time which is longer than said predetermined period, the machine will be switched off because an adequate supply of the knitting machine can no longer be guaranteed.

Each of the above-mentioned signal chains can also be used for quality assurance of the knitted material, the information contained in the signal chain being compared with an information on the thread consumption rate. If the thread consumption rate decreases temporarily while the storage body is still rotating at a high rotational speed, the thread withdrawal point will rotate due to the overhead withdrawal and the thread will be twisted. This twisting is undesirable. An evaluation and comparator circuit, which is coupled to the control device of the rotary drive means and which has supplied thereto information on the instantaneous consumption rate and supervises also the respective signal chain, determines the ratio of the rotational speed of the storage body to the thread consumption rate. If the thread consumption rate decreases while the storage body is still rotating at a high speed, the storage body will be stopped immediately by this circuit, if necessary with application of a brake so as to avoid the detrimental twisting.

A safety function activated when an excessive amount of thread is supplied to the storage surface is carried out in a similar manner. For this purpose, the rotational speed of the storage body tapped from one of the above-mentioned signal chains is examined so as to find out the maximum value thereof. If the maximum rotational speed is ascertained, a predetermined period of time will be allowed to elapse so as to see whether the sensors will respond and report the thread supply in the scanning zone. The period of time is chosen such that, even in the case of maximum consumption, the thread supply should reach the scanning zone. If the sensors do not respond within this period of time, an additional period of time amounting to approx. 50% of the first-mentioned period is allowed to elapse before the machine will be switched off because the fact that the sensor signals do not occur at the end of this period shows that said sensors do not work properly and an excessive amount of thread is present on the storage surface.

According to the invention, the scanning is carried out optoelectronically and contactless. This guarantees that delicate thread material is treated as carefully as possible.

Further, where the storage body is rotatable, a window signal related to at least one circumferential point or one circumferential area is derived from the rotary movement of the storage body which is adapted to be rotationally driven. Scanning is effected stroboscopically so that transition regions between the circumferential sections which may be critical with respect to scanning or evaluation are disregarded. In order to scan in the stopped condition of the storage body, the storage body always stops at such a position that a respective window signal is applied. The window signal or the distance between two window signals is used as a means for triggering the thread supply scanning operation, the duration or the range of the rotary angle of the window signal being shorter than the duration or the range of the rotary angle in the course of which each circumferential section could be scanned completely. The rotary position sensor can be directed at a threadfree area of the storage body or of the drive shaft of said storage body.

On the basis of the alternatives existing with regard to the evaluation of the differences, in particular, by comparing signals with every other signal, the largest signal with respect to the smallest signal, or evaluating the signal s with respect to a threshold value, unequivocal information is obtained, which reveals whether or not the boundary of the thread supply has reached the scanning zone.

The embodiment where the storage body 1 rotates and the sensors are stationary is structurally simple and is preferably adapted to be used for supplying thread to a knitting machine. The structural accommodation of the sensors protects them against the influence of extraneous light and permits an exact orientation and positioning of said sensors.

On the basis of the embodiment where the sensors (S, SA, SB) are spaced apart the distance between the circumferential sections or multiples thereof, exact information on the position of the boundary of the thread supply is also possible when the storage body is standing still because said storage body will only stop if the sensors are directed at both circumferential sections of the storage surface at the same time.

Another embodiment comprises three sensors which are circumferentially spaced in such a way that first and second circumferential sections of the storage surface can always be detected at the same time.

Where a stationary rotary position sensor TS is provided, rotary position signals are produced as window signals so as to determine when and over which area the circumferential sections of the storage surface are respectively scanned. Furthermore, each rotary position signal can be used for stopping the storage body at a precisely predetermined point, e.g. by decelerating the storage body by means of a reversal of the field direction in the case of an asynchronous motor, or by searching for the window signal at a creep speed. Finally, it is possible to derive information on the rotational speed, the acceleration or deceleration and the state: rotation or standstill, and this can be important with respect to auxiliary safety functions.

Since the circumferentially adjacent sensors S, SA, SB are spaced apart about two-thirds the width of the circumferential sections 8, 9 or a multiple thereof, an almost sinusoidal signal waveform, which is easy to evaluate, is obtained by the predetermined distances between the sensors.

In the structurally simple embodiment where the storage body is a rod cage, the longitudinal rods and the interspaces or longitudinal grooves define the first and second circumferential sections with clearly different optical, mechanical and the like scanning properties. The supporting surfaces used for the thread windings have an optimally small size.

The scanning properties are very different because the surfaces of the longitudinal rods produce a mirror effect, whereas, e.g. in the case of optoelectronic scanning with reflective light, the interspaces or the longitudinal grooves between the rods hardly exist or exist not at all. On the other hand, the mirrored or chromium-plated and polished surfaces of the longitudinal rods guarantee easy axial sliding of the thread windings. Furthermore, an advance element can easily be integrated therewith for advancing the yarn.

The control circuit L effects by means of simple measures in the field of control engineering the discrimination between the thread signals and the storage surface signals whose clearly detectable difference (signal voltage differences, with a positive sign or as absolute values) is adapted to be evaluated for generating clear and precise control signals. In view of the fact that, irrespectively of which sensor produces one of the nonidentical signals and which sensor produces the other nonidentical signal, whenever nonidentical signals occur simultaneously in the circuit, definitive information on the absence of the boundary of the thread supply is provided. If no simultaneous nonidentical signals appear in the logic circuit, definitive information on the presence of thread windings in the scanning zone is provided. It is also possible to obtain the information on the presence of thread in the scanning zone by discrimination between the identical thread signals and the nonidentical signals. The circuit can be integrated in a microprocessor control or closed-loop control for the rotary drive means or it can at least be connected thereto so that the rotary drive means can be controlled sensitively and so that parameters related to the specific case of use can additionally be taken into account.

The embodiment which includes the stationary storage body is adapted to be used universally as a weft yarn storage and feed device for weaving machines. The structural design making use of a rod cage provides the necessary circumferential sections and permits integration of an advance element.

Where the sensors are movable axially, the desired size of the thread supply can be adjusted.

A plurality of scanning zones can be provided in the axial direction of the storage body, e.g. for being capable of supervising the movement of the boundary of the thread supply between a maximum size and a minimum size and, if desired, also in a medium range (analog detection).

The embodiment where the sensors are optoelectronic sensors is moderate in price, compact and reliable. The circumferential sections are constructed such that the differences between their scanning properties are as clear as possible.

Alternative types of sensors such as inductive, magnetic, mechanical, pneumatic, or ultrasonic sensors may be advantageous in the cases in which optoelectronic scanning is undesirable for special reasons. The circumferential sections, thus, are formed of different materials with different inductive, magnetic, mechanical or echo properties.

The embodiment wherein each sensor is a reflection type sensor having an emitter for infrared light and a photodiode which responds thereto is not susceptible to trouble.

According to the embodiment where the switch-on control means includes a machine stopping switch with a time holding function, the rotary speed information is used for safety supervision so as to avoid faulty material in cases in which no thread is supplied although a working signal indicates that the machine is ready to work. If, for example, the thread tension exceeds the torque of the rotary drive means on the feed side, the rotary drive means will no longer be able to drive the storage body and to feed a sufficient amount of thread to the thread supply, whereupon the machine will be switched off. A predetermined period of time elapsing after the appearance of the working signal and the nonappearance of the signal chain is necessary so as to guarantee normal starting of the storage body from the condition in which it is standing still, or acceleration of said storage body which may occur during normal operation. The speed information is also adapted to be used for switching off if the thread supply contains an excessive amount of thread due to inoperative sensors. For this purpose, the maximum speed of the rotary drive means is supervised for a predetermined period of time within which the boundary of the thread supply will normally reach the scanning zone where it can be detected. If this is not the case, the machine will be switched off after an additional period of time amounting e.g. to 50% of the first-mentioned period.

Where the evaluation and comparator circuit is connected to the switch-on control means of the rotary drive means, the storage body will be decelerated until it is standing still in response to a detected ratio of the rotational speed to the thread consumption rate, e.g. when the consumption rate has rapidly dropped to zero, so that the withdrawal point of the thread will no longer rotate, since this rotation would cause undesirable twisting of the thread taken off. The brake will prevent after-running of the storage body which would otherwise be caused by inertia. When an asynchronous motor is used in the rotary drive means, this control may just as well be effected electrically by a reversal of the field direction (electric motor brake).

We claim:

1. A thread storage and feed device for thread-processing machines comprising a housing, a drum-shaped storage body supported on said housing and defining a storage surface for a thread supply which is defined by thread windings which are wound circumferentially on said storage surface, said storage surface having at least distinct first and second circumferential sections, said storage and feed device further comprising at least one signal-generating sensor supported by said housing, said sensor being directed toward a predetermined scanning zone of the storage surface for determining a movement of a boundary of the thread supply, comprising the improvement wherein said scanning zone extends in a circumferential direction of said storage surface and includes said first and second circumferential sections which are substantially circumferentially aligned with one another, the first and second circumferential sections of the storage surface differing from one another with respect to their respective scanning properties, and at least two said sensors being provided on said housing and being positioned in such a way that the scanning property of said first circumferential section or of the thread supply when said thread supply is disposed on said first circumferential section is scanned by a first one of said sensors and that, simultaneously, the scanning property of said second circumferential section or of the thread supply when said thread supply is disposed on said second circumferential section is scanned by a second one of said sensors, said first and second sensors simultaneously detecting either the differing scanning properties of said first and second circumferential sections when said thread supply is absent from said scanning zone or the scanning Property of said thread supply when said thread supply extends circumferentially over said first and second circumferential sections.

2. A thread storage and feed device according to claim 1, wherein the storage body is rotatably supported on said housing and connected to rotary drive means for rotating said storage body in said circumferential direction to supply thread to the thread supply, the first and second sensors being arranged in a stationary manner relative to the storage body, said first and second sensors being attached to said housing of the thread storage and feed device.

3. A thread storage and feed device according to claim 2, wherein the first and second sensors are integrated in parallel in a circuit by means of which control signals for the rotary drive means are derived by discriminating between storage surface signals generated by said first and second sensors when said thread supply boundary is absent from said scanning zone and thread signals generated by said first and second sensors when said thread supply boundary is disposed in said scanning zone.

4. A thread storage and feed device according to claim 2, wherein a switch-on control means of the rotary drive means has associated therewith a machine stopping switch with a time holding function, which responds to a working signal of the thread storage and feeding device and to the appearance of a rotational speed-dependent storage surface signal chain, or a rotary position or window signal chain, each of said signal chains having alternating signal levels, said machine stopping switch being operated by said switch-on control means when a predetermined period of time has elapsed after the nonappearance or after the appearance of alternating signal levels indicating the maximum admissible speed.

5. A thread storage and feed device according to claim 2, which includes an evaluation and comparator circuit connected to a switch-on control means of the rotary drive mean s and said first and second sensors, said first and second sensors supplying signals to said evaluation and comparator circuit which indicate an amount of thread consumed, said rotary drive means defining a rotational steed for said storage body and the rotational speed being determined on the basis of the frequency of alternating signal levels of a storage-surface or rotary-position signal chain which depends on the rotational speed, said rotational speed of the storage body being compared by said evaluation and comparator circuit with said supplied signals on the amount of thread consumed so as to actuate said control means to stop the storage body if the amount of thread consumed deminishes strongly, a controllable brake being provided for the purpose of stopping.

6. A thread storage and feed device according to claim 1, wherein the storage body is driven by rotary drive means such that it rotates, said storage body has additionally associated therewith a stationary rotary position sensor supported on said housing for producing rotary position signals as said storage body rotates for triggering the scanning of the first and second circumferential sections of the storage surface by said first and second sensors or for providing information on the rotational speed.

7. A thread storage and feed device according to claim 1, wherein the storage body is a rod cage comprising axially extending longitudinal rods and longitudinal grooves or interspaces which are provided between said rods and which are provided for passing therethrough advance elements for advancing the thread supply in an axial direction toward said scanning zone, the longitudinal rods defining the first circumferential section and the longitudinal grooves or interspaces defining the second circumferential section of the storage surface.

8. A thread storage and feed device according to claim 7, wherein the longitudinal rods have light reflective surfaces, and a light-absorbing background is provided in the longitudinal grooves or the interspaces.

9. A thread storage and feed device according to claim 1, wherein the storage body is a rod cage and is rotatably supported on a drive shaft of a thread winding member, said thread winding member being connected to rotary drive means and being retained by holding means such that it is secured against rotation with said drive shaft and is rotatable about said storage surface, said first and second sensors being circumferentially spaced apart and arranged in a stationary manner relative to the storage body and relative to the winding member, said first and second sensors being attached to said housing of the thread storage and feed device.

10. A thread storage and feed device according to claim 1, wherein the first and second sensors are combined in one structural unit with fixed interspaces between them and are adapted to be displaced in the direction of an axis of the storage body.

11. A thread storage and feed device according to claim 1, wherein several circumferentially extending scanning zones are provided which are axially offset in an axial direction, said scanning zones each including first and second circumferential sections and groups of said first and second sensors associated therewith which are simultaneously directed at said first and second circumferential sections of the storage surface in the associated scanning zones, two of said axially offset scanning zones being provided for respectively sensing minimum and maximum sizes of the thread supply or three of said axially offset scanning zones being provided for respectively sensing minimum, maximum and medium reference sizes of the thread supply.

12. A thread storage and feed device according to claim 1, wherein each of said first and second sensors is an optoelectronic sensor comprising a light source and a photodiode, said different scanning properties of the first and second circumferential sections of the storage surface being defined by one of the group consisting of optical transparency, reflection or absorption behavior, color, surface finish, a selected distance from the sensor, and a coating.

13. A thread storage and feed device according to claim 1, wherein said first and second sensors are selected from one of the group consisting of inductive, magnetic, mechanical, pneumatical and ultrasonic sensors, said scanning properties of said first and second circumferential sections being defined by one of the group consisting of different materials having different inductive, magnetic, mechanical or echo properties, different distances from the sensors, and different surfaces.

14. A thread storage and feed device according to claim 12, wherein each of said first and second sensors is a reflection sensor which scans an area and which includes an emitter for infrared light, and a photodiode responding to reflected light.

15. A thread storage and feed device for thread-processing machines comprising a housing, a drum-shaped storage body supported on said housing and defining a storage surface for a thread supply which is defined by thread windings on said storage surface, said storage surface having at least distinct first and second circumferential sections, said storage and feed device further comprising at least one signal-generating sensor supported by said housing, said sensor being directed toward a predetermined scanning zone of the storage surface for determining a movement of a boundary of the thread supply, comprising the improvement wherein said scanning zone extends in a circumferential direction and includes said first and second circumferential sections which are disposed circumferentially relative to one another, the first and second circumferential sections of the storage surface differing from one another with respect to their scanning properties, and at least two said sensors being provided on said housing and being positioned in such a way that the scanning property of said first circumferential section or of the thread supply when said thread resupply is disposed on said first circumferential section is scanned by a first one of said sensors and that, simultaneously, the scanning property of said second circumferential section or of the thread supply when said thread supply is disposed on said second circumferential section is scanned by a second one of said sensors, said first and second circumferential sections being circumferentially spaced apart, and a distance between the first and second sensors corresponding to a circumferential spacing between the first and second circumferential sections of the storage surface or to an integral multiple thereof, said storage body being connected to rotary drive means for rotating said storage body, said rotary drive means including means for stopping the storage body exclusively at a rotary position at which the first and second sensors are simultaneously directed at the first and second circumferential sections of the storage surface.

16. A thread storage and feed device for thread-processing machines comprising a housing, a drum-shaped storage body supported on said housing and defining a storage surface for a thread supply which is defined by thread windings on said storage surface, said storage surface having at least distinct first and second circumferential sections, said storage and feed device further comprising at least one signal-generating sensor supported by said housing, said sensor being directed toward a predetermined scanning zone of the storage surface for determining a movement of a boundary of the thread supply, comprising the improvement wherein said scanning zone extends in a circumferential direction of said storage drum and includes a plurality of said first and second circumferential sections arranged in said circumferential direction in an alternating arrangement, at least first, second and third sensors being provided such that said first to third sensors are circumferentially spaced from one another in such a way that one of said first to third sensors is directed at one of said first circumferential sections and another of said first to third sensors is simultaneously directed at one of said second circumferential sections of the storage surface, the first and second circumferential sections of the storage surface differing from one another with respect to their scanning properties, the scanning property of said first circumferential section or of the thread supply when said thread supply is disposed on said first circumferential section being scanned by said one of said first to third sensors and that, simultaneously, the scanning property of said second circumferential section or of the thread supply when said thread supply is disposed on said second circumferential section being scanned by said another of said first to third sensors.

17. A thread storage and feed device according to claim 14, wherein the space between two circumferentially adjacent ones of said first to third sensors corresponds to two thirds of the width of the first or second circumferential sections of the storage surface or to an integral multiple thereof.

18. A method of determining the movement of a thread supply boundary of a thread supply on a storage surface, said storage surface defined by a drum-shaped storage body of a thread storage and feed device for a thread-processing machine, said storage and feed device including scanning means which scans a scanning zone on said storage surface to control supplying of the thread to said thread supply depending upon the presence or absence of said thread supply in said scanning zone, said method comprising the steps of:

providing first and second circumferential sections of said storage surface which are disposed in said scanning zone and are circumferentially offset one with respect to the other, said first and second circumferential sections having different scanning properties;

scanning said first and second circumferential sections to 1) produce at least two non-identical storage surface signals which respectively correspond to said different scanning properties of said first and second circumferential sections in the absence of said thread supply boundary, and 2) produce at least two substantially identical thread signals corresponding to a scanning property of said thread supply covering said first and second circumferential sections in the presence of said thread supply boundary;

controlling supplying of said thread to said thread supply in response to said non-identical storage surface signals and said substantially identical thread signals being produced by said scanning step; and whereby said scanning property of at least one of said circumferential sections differs from said scanning property of said thread.

19. A method according to claim 18, wherein said scanning of the respective scanning properties of said first and second circumferential sections and said thread supply is done optoelectronically and contactless by said sensor means which comprise a plurality of sensors distributed in the circumferential direction along the scanning zone of the storage body, said thread signals being absent when said storage surface signals are present and said thread signals being present when said storage surface signals are absent, said supplying of said thread being dependent upon the presence or absence of said storage surface signals which are nonidentical among themselves and the corresponding absence and presence of said thread signals which are identical among themselves.

20. A method according to claim 18, further comprising the steps of:

scanning a relative rotary movement of the storage surface to produce individual window signals in response to said rotary movement of said storage surface; and performing said scanning of said first and second circumferential sections either during one of said window signals or between successively occurring said window signals.

21. A method according to claim 18, further comprising the steps of:

carrying out a comparison between said non-identical storage surface signals by either comparing a signal value of one of said storage surface signals with every other signal value of said other storage surface signals, or comparing a largest signal value of said storage surface signals with a smallest signal value of said storage surface signals; and said comparison step further including the step of evaluating either a positively-signed difference between all said signal values, or a difference between said largest and said smallest signal values with respect to a threshold value.

22. A method according to claim 18, wherein said controlling step further comprises the step of reducing said supplying of said thread supply to said storage surface when said substantially identical thread signals are produced by said scanning step.

23. A thread storage and feed device for a thread-processing machine, comprising:

a housing;

a storage drum supported on said housing and defining a circumferential storage surface which stores a thread supply thereon defined by a plurality of thread windings, said storage surface including a scanning zone which extends in a circumferential direction and comprises at least first and second circumferential sections of said storage surface, said first circumferential section being circumferentially offset relative to said second circumferential section, and said first and second circumferential sections having respective first and second scanning properties which are different one from the other;

sensor means for scanning said first and second circumferential sections, said sensor means being supported by said housing and directed toward said scanning zone of said storage surface to detect the presence of a thread supply boundary of said thread supply in said first and second circumferential sections, said sensor means generating non-identical first and second storage surface signals which respectively correspond to said respective first and second scanning properties of said first and second circumferential sections when said thread supply boundary is absent from said first and second circumferential sections, and said sensor means generating substantially identical first and second thread signals corresponding to a scanning property of said thread when said thread is disposed in said first and second circumferential sections; and control means connected to said sensor means which discriminates said non-identical first and second storage surface signals from said substantially identical first and second thread signals for controlling supplying of said thread supply to said storage surface in dependency upon the presence of said thread supply boundary within said first and second circumferential sections;

whereby said scanning property of at least one of said first and second circumferential sections differs from said scanning property of said thread.

24. A thread storage and feed device according to claim 23, wherein said first and second circumferential sections extend about a partial circumference of said storage drum.

25. A thread storage and feed device according to claim 24, wherein a plurality of pairs of said first and second circumferential sections are disposed circumferentially about said storage drum.

26. A thread storage and feed device according to claim 23, wherein said sensor means comprise first and second sensors which are directed respectively toward said first and second circumferential sections to detect said different first and second scanning properties thereof.

27. A thread storage and feed device according to claim 23, wherein said first and second circumferential sections are substantially circumferentially aligned.

28. A thread storage and feed device according to claim 23, wherein said first and second circumferential sections are circumferentially spaced apart.

29. A thread storage and feed device according to claim 23, wherein said first circumferential section is contiguous with said second circumferential section.

* * * * *

UNITED STATES PATENT AND TRADEMARK OFFICE

CERTIFICATE OF CORRECTION

PATENT NO. : 5 765 399

DATED : June 16, 1998

INVENTOR(S) : Rolf Huss et al

It is certified that error appears in the above-indentified patent and that said Letters Patent is hereby corrected as shown below:

Column 12, line 54; change "Property" to ---property---.

Column 13, line 13; change "chain, or" to ---chain or---.
lines 22 and 23; change "mean s" to ---means---.
line 26; change "steed" to ---speed---.

Column 14, line 65; change "resupply" to ---supply---.

Column 15, lines 47 and 48; change "claim 14," to ---claim 16,---.

Signed and Sealed this

Thirteenth Day of October 1998

*Attest:*

*Attesting Officer*

Bruce Lehman

BRUCE LEHMAN

*Commissioner of Patents and Trademarks*